United States Patent [19]

Bloomfield et al.

[11] 4,456,187

[45] Jun. 26, 1984

[54] APPARATUS FOR INDIVIDUAL YARN SELECTION PARTICULARLY IN DONNING MULTICOP WINDERS

[75] Inventors: Allen A. Bloomfield; Frank R. Wilson, both of Harrogate, England

[73] Assignee: Imperial Chemical Industries Limited, London, England

[21] Appl. No.: 408,098

[22] Filed: Aug. 13, 1982

Related U.S. Application Data

[63] Continuation-in-part of Ser. No. 219,280, Dec. 22, 1980, abandoned.

[30] Foreign Application Priority Data

Feb. 26, 1980 [GB] United Kingdom ..... 8006407

[51] Int. Cl.[3] ..... B65H 54/02; B65H 54/20

[52] U.S. Cl. ..... 242/18 PW; 242/35.5 R

[58] Field of Search ..... 242/18 PW, 18 R, 18 A, 242/18 DD, 25 A, 35.5 R

[56] References Cited

U.S. PATENT DOCUMENTS 4,230,283 10/1980 Hamaguchi et al. ..... 242/18 PW
4,313,576 2/1982 Claret et al. ..... 242/18 PW

FOREIGN PATENT DOCUMENTS 2378708 8/1978 France ..... 242/18 PW
2002431 2/1979 United Kingdom ..... 242/18 PW

*Primary Examiner*—Stanley N. Gilreath
*Attorney, Agent, or Firm*—Herbert M. Adrian, Jr.

[57] ABSTRACT

An improved yarn guide assembly for selecting yarns individually from a group in the donning of a multicop winder, the assembly being of the kind in which each gap in a row of guide members is shaped to receive a yarn only if it lies in a unique plane, the improvement being that the yarn guiding surfaces of the guide members immediately beyond the gaps, are inclined to, and at least partially face, the direction from which the yarns approach the gaps and, optionally, that each guiding surface immediately beyond the gaps contains at least one ratchet notch.

7 Claims, 14 Drawing Figures

APPARATUS FOR INDIVIDUAL YARN SELECTION PARTICULARLY IN DONNING MULTICOP WINDERS

This is a continuation-in-part of Ser. No. 219,280 filed Dec. 22, 1980, now abandoned.

This invention relates to the automatic selection of individual yarns from a group, and particularly but not exclusively to such selection as a step in automatic donning of yarns onto multicop winding spindles.

Concurrently advancing yarns may be engaged automatically with rotating bobbins on a common spindle by passing them from fixed feed guides to an aspirator via moveable donning guides, and then moving the donning guides round the spindle so that the yarns are caused to contact the bobbins and engage in notches or slots in them. The yarns are then cut between the bobbins and the aspirator.

An operator can easily select manually each individual yarn from such a group travelling from individual feed guides to a common aspirator, and thread it into its appropriate donning guide, but there has been a problem in effecting this selection automatically. In British Patent Specification Number 2 002 431A a method of automatically making this selection is described in which a group of yarns, passing from fixed individual feed guides to a moveable common convergence point in an aspirator, is caused to pass along yarn guiding surfaces and over a series of openings by moving the aspirator. The openings are shaped to receive a yarn only if, as it passes the mouth of the opening, it lies in a predetermined plane: and the predetermined plane of each opening is oriented to be capable of receiving only one yarn out of the group: so that by moving the aspirator each yarn can in turn be received by and become engaged in a different one of the openings. Nevertheless, in practice, problems arise with such an arrangement and similar arrangements described in British Patent Specification Number 2 034 778A (corresponding to U.S. Pat. Nos. 4,313,576), 4,230,283 and French Patent Specification Number 2 378 708. A yarn which is not angled suitably to be received into an opening can get caught or hooked by it, instead of passing smoothly over and past it, towards the next opening. This occurs when a yarn contacts a non guiding surface which prevents further movement of the yarns at this point in the intended direction of yarn movement.

According to this invention we provide an improved elongate yarn guide assembly for selecting individual yarns from a group concurrently deflected over it and sliding laterally along it while advancing longitudinally from fixed spaced apart individual yarn feed means to moveable common yarn collection means, the assembly comprising a row of yarn guide members having yarn guiding surfaces separated by gaps, characterised in that the yarn guiding surfaces of the guide members immediately beyond the gaps, are inclined to, and at least partially face, the direction from which the yarns approach the gaps, whereby a yarn deflected over and sliding along the assembly passes over the guiding surfaces and the gaps without impedance from hooking except when the yarn lies in a plane wholly within a gap, in which case it falls into that gap.

A narrow parallel sided gap between two coaxial prismatic members such as rectangular blocks or right cylinders over which yarns are deflected can select a yarn in line with the gap from ones not in line with it because only that one yarn can fall through it, but a yarn deflected over and sliding along the first member, and not lined up to fall through the gap when it reaches it, can fall off the trailing end of the first guide member and can get hooked on the leading end of the next guide member across the gap so that it does not slide along the guiding surface of the second guide member. In a guide assembly according to this invention such hooking is avoided by ensuring that the guiding surface first contacted by the yarn at the leading end of the second member as it falls across the gap is inclined to, and at least partially faces, the direction from which the yarns approach the gap. It should be understood that the ends of the coaxial rectangular blocks or right cylinders are not guiding surfaces even though they may face the direction from which the yarns approach the gap.

The avoidance of hooking can be understood in terms of the angle between the desired sliding direction along the guide assembly and the direction of a portion of a guide surface between a point A and a point B. The direction of that surface can be defined as the direction of a line projecting normally from it in the plane defined by the lines of a yarn deflected over it. If that line forms an acute angle with the desired sliding direction, sliding will occur from A to B readily; if it forms an obtuse angle, sliding can occur from A to B providing that the sliding or rolling friction between yarn and guide is low enough: but if the normal forms a straight or reflex angle, either there will be no sliding or the sliding direction will be reversed from A to B to B to A. An assembly according to the invention is so shaped that at least a portion of a guide surface touched by the yarn, more particularly the critical leading portion first touched when a yarn falls across a gap from the trailing end of the previous guide, has a normal which is angled at less than 180° to the sliding direction along the assembly. Preferably obtuse angles are minimised, to reduce frictional drag and preferably acute angles are limited to the trailing end of a guide.

Preferably the non hooking guide surface onto which a non selected yarn falls as it traverses a gap is interrupted by at least one ratchet notch which permits normal lateral yarn movement towards the next gap but prevents accidental reverse yarn movement back towards the gap it is traversing. Such accidental reverse yarn movement may be caused for instance by slight flutter in the lateral sliding motion or by the rolling out of twist inserted by the aspirator. If sufficiently great it can result in a yarn, although traversing the gap between two guide surfaces, occasionally accidentally back tracking to the leading end of the second surface just at the moment it falls off the trailing end of the first surface, and thus accidentally falling into the gap even though its general angle is incorrect for proper selection by the gap. The combination of non hooking guide surface angles and ratchet notches near their leading ends ensures that each yarn reaches its correct gap for proper selection and is neither hooked nor accidentally selected at a previous gap.

A guide assembly according to the invention also conveniently has an arcuate nose so that when the aspirator is moved towards the assembly along a line substantially parallel with it while receiving yarns direct from the feed means, the nose first contacts the yarns and deflects them so that they can slide over the guiding surfaces in the assembly.

A guide assembly according to the invention may in certain situations conveniently be integrally formed with self threading guides arranged so that each gap between guiding surfaces is an entrance into a self threading guide. These self threading guides can then be used as the donning guides of a multi cop winder. For use in donning multicop winders however we prefer to use a robust stationary yarn selector guide assembly and a separate moveable donning guide assembly of lighter construction, because the selecting, non hooking and easy sliding of yarns deflected over the assembly depend critically on the accurate relative positioning of the guiding surfaces and this is easier to achieve and to maintain in a heavy fixed construction than in a light mobile construction: whereas the geometrical detail of the donning guides is much less critical but their movement is facilitated if they are of light construction.

When a yarn travelling from a fixed feed guide over a selector guide assembly to an aspirator falls through an appropriately oriented slot in the assembly its lateral movement is naturally very small near the feed guide and the aspirator and greatest near the selector assembly. The selector assembly is therefore conveniently placed near to the guides into which the yarn is to be threaded. However during the donning process it is necessary not only to thread the yarns into the donning guides but also to thread them into other winding guides. The whole apparatus can therefore be made both more compact and more positively reliable in operation if it comprises more than one selector assembly over which the yarn can be deflected round the winder from the feed guides to the aspirator so that lateral movement of a selected yarn adequate for guide threading can be achieved near the winding guides as well as near the donning guides without having to make either movement unnecessarily large.

By way of example six guide assemblies according to the invention are illustrated in the accompanying drawings in which FIG. 1A is a front elevation of an assembly according to the invention behind four yarns advancing from four yarn feed guides to an aspirator.

Figure 4A:
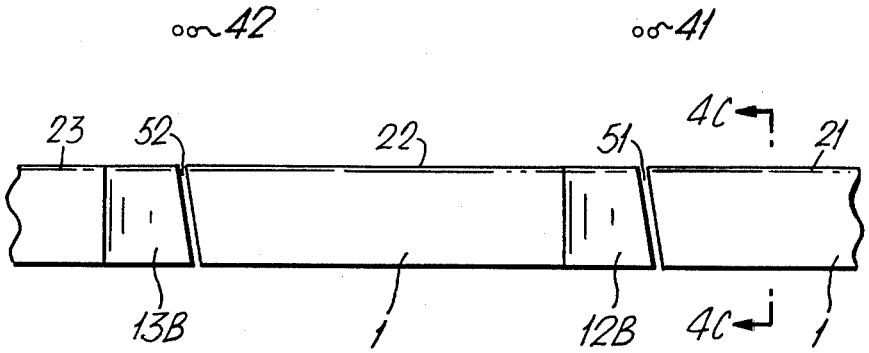
Figure 4B:
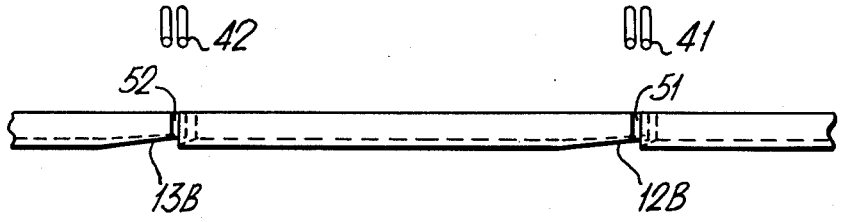
Figure 4C:
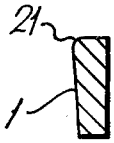

FIGS. 4A, 4B and 4C respectively a front elevation, a plan view and a cross section on the line 4C of FIG. 4A, illustrating a part of another assembly of profiled guide members according to the invention with angled gaps between them.

Figure 5A:
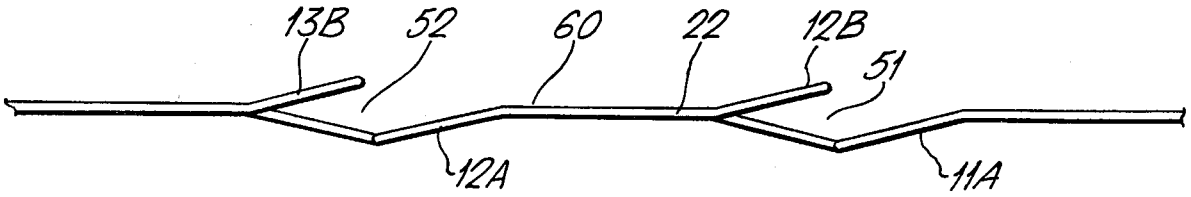
Figure 5B:
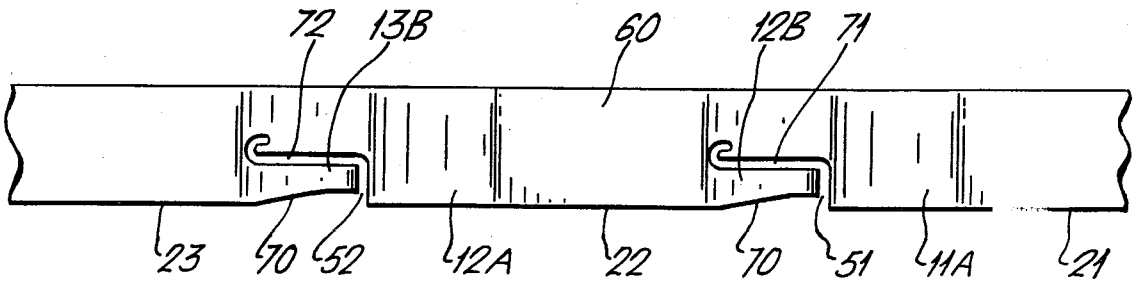

FIGS. 5A and 5B are a front elevation and a plan view respectively of a part of an assembly according to the invention comprising a cut out and bent metal strip. In this embodiment of the invention the assembly is of light construction and is formed integrally with self threading guides to provide an integral selector and donning guide assembly.

Figure 6:
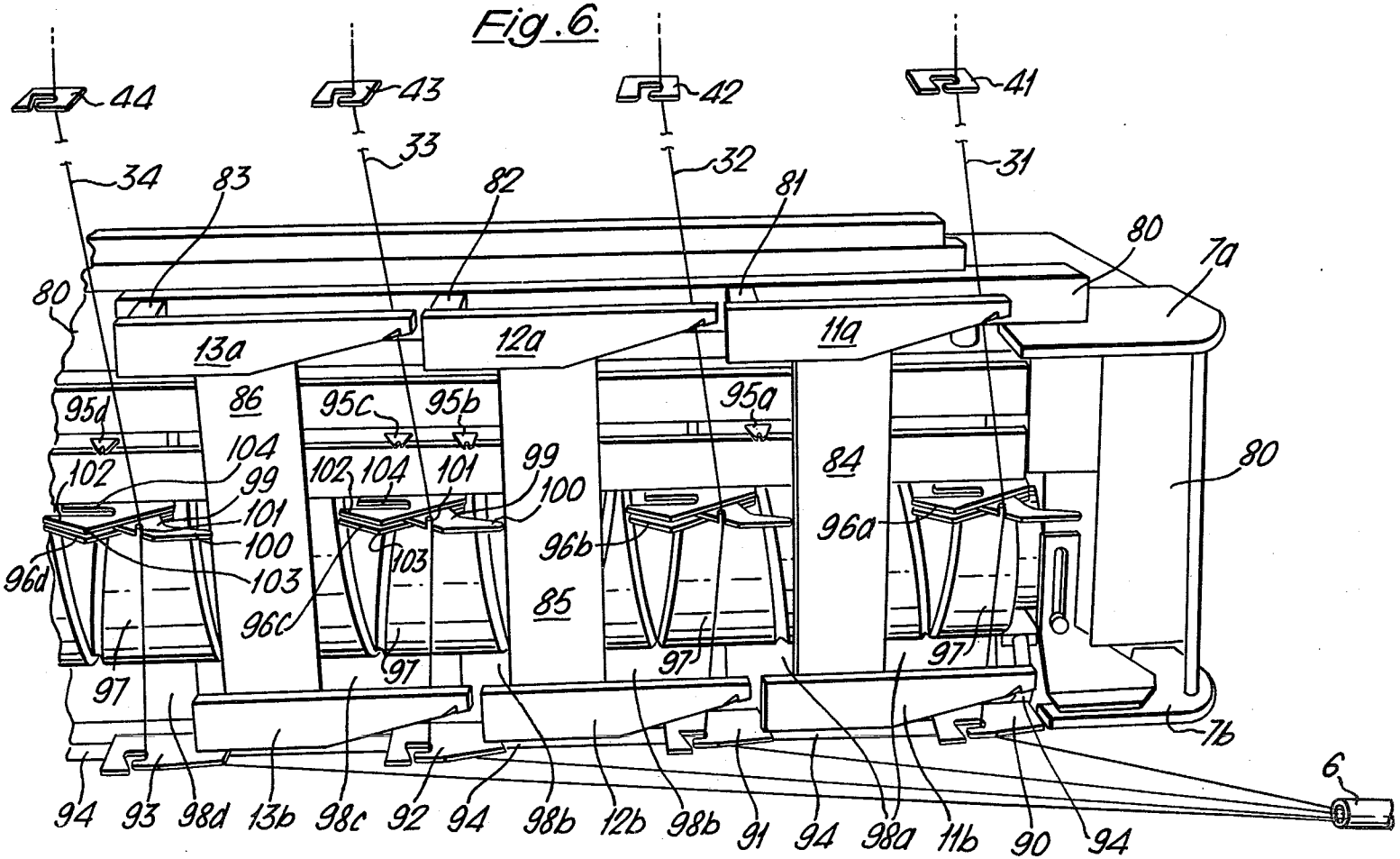

FIG. 6 is a perspective view of a pair of fixed selector guide assemblies in position for use to thread the winding guides and donning guides of a four cop yarn winder.

Figure 1A:
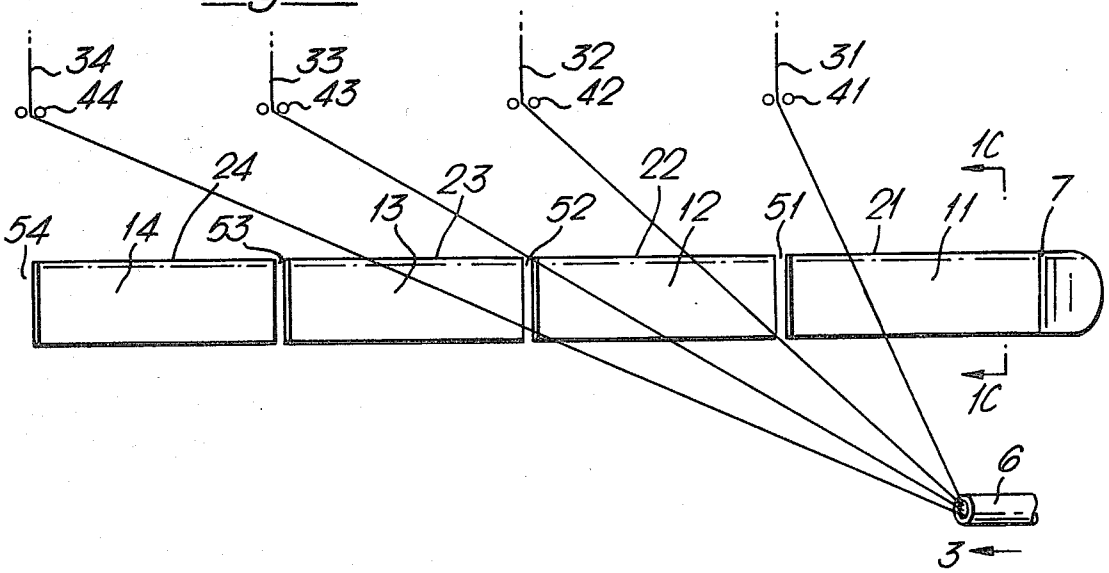
FIG. 1B is a plan view of the arrangement of FIG. 1A but with the yarns themselves omitted for clarity.
FIG. 1C is a cross section on line 1C of FIG. 1A.
Figure 1B:
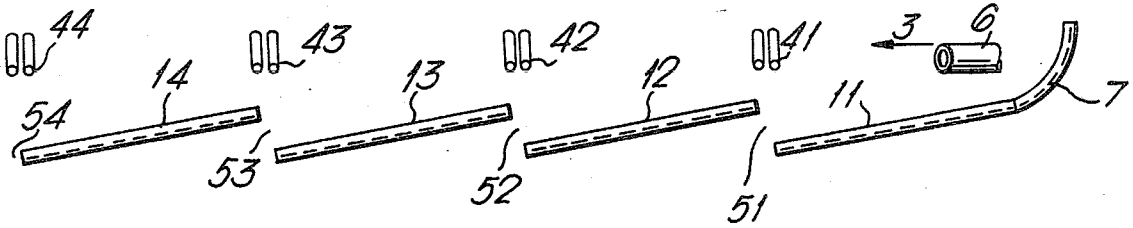

In FIGS. 1A and 1B rectangular guide members 11, 12 13 and 14 are arranged in a row in echelon with guide surfaces 21, 22, 23 and 24 obtusely angled with respect to a sliding direction 3 from right to left along the assembly. Yarns 31, 32, 33 and 34 are deflected over the assembly in their paths from feed guides 41, 42, 43 and 44 to an aspirator 6. Feed guides 41, 42, 43 and 44 are positioned above gaps 51, 52, 53 and 54 respectively.

In front of the first rectangular guide member 11 there is an arcuate guide member 7.

In operation, starting with the four yarns 31, 32, 33 and 34 travelling from the four guides 41, 42, 43 and 44 to the aspirator 6 in a position to the right of the drawings, the aspirator is moved to the left in the direction of the arrow 3 and the yarns come into contact with the arcuate nose member 7 which deflects them in turn onto guide surface 21 of the first guide member 11. The first yarn, 34, reaches the end of member 11 at an angle which prevents it from falling into gap 51 but when it falls off member 11 it falls onto the guide surface 22 of member 12 and does not get hooked on the end of member 12. Only yarn 31 meets the end of member 11 at an angle permitting it to fall through gap 51, and the other gaps similarly select the other yarns.

Figure 2A:
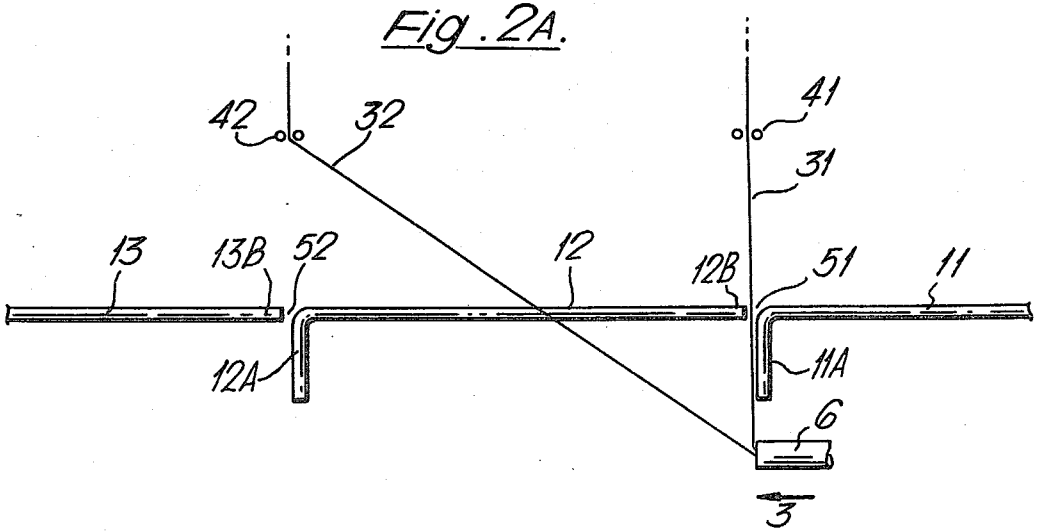
FIGS. 2A and 2B are a front elevation and a plan view respectively, illustrating a part of another assembly according to the invention in which the guide members are bent rods.
Figure 2B:
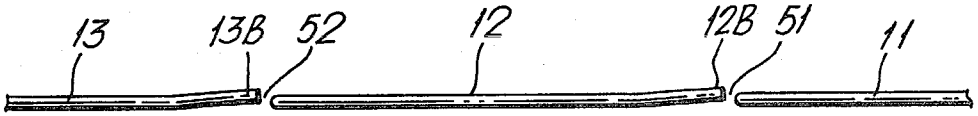

In FIGS. 2A and 2B the rod guide members 11, 12 and 13 are bent to achieve the same result. Their left hand ends 11A and 12A are bent downwards in the plane of FIG. 2A and their right hand ends 12B and 13B are bent slightly backwards in the plane of FIG. 2B.

The left hand ends 11A and 12A define a gap direction so that only yarn 31 can fall into gap 51 as illustrated, and the right hand ends 12B and 13B provide a non hooking action by ensuring that the end face of the rod is never contacted by the yarn as a guide face: only the cylindrical face of the rod is a guide face.

Figure 1C:
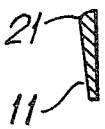
Figure 3A:
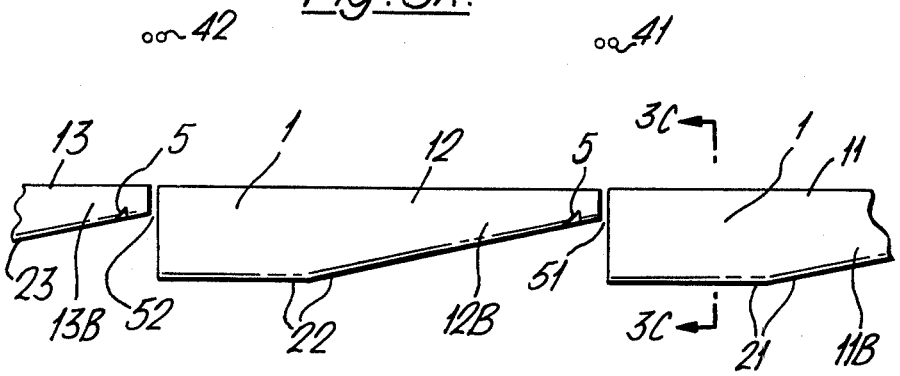
FIGS. 3A and 3B and 3C are respectively a front elevation, a plan view and a cross section on line 3C of FIG. 3A, illustrating a part of an assembly according to the invention comprising profiled guide members and vertical gaps between them.
Figure 3B:
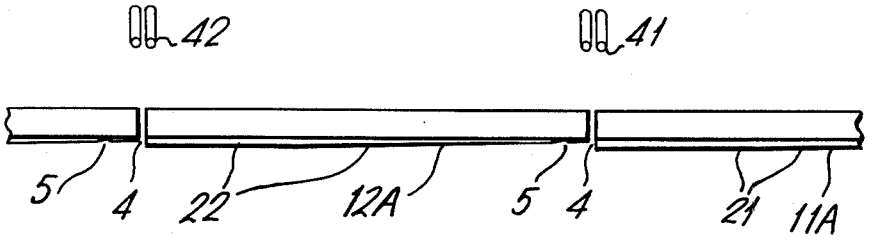
Figure 3C:
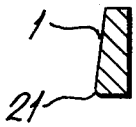

FIGS. 3A, 3B and 3C illustrate a portion of another assembly according to the invention which is an improved design based on the echelon design of FIG. 1.

In FIGS. 3A, 3B and 3C the guide members 11, 12 and 13 are arranged in line and have front faces 1 which are sloping so that they point slightly upwards and are chamfered at their right hand portions 11B, 12B and 13B so that their bottom edges 21, 22 and 23, which are used as the yarn guide edges, are disposed similarly to the echelon arrangement of FIG. 1, as is seen most clearly in FIG. 3A. The gaps 51 and 52 between adjacent members are in line with yarn guides 41 and 42. Ratchet notches 5 in guide surfaces 22 and 23 suppress any accidental reverse yarn movement to the right at the critical moment when a non selected yarn has just fallen across a gap onto the leading end of a guide surface 22 and 23, and is most unstable and could still, due to any accidental back tracking, fall into the gap when the yarn finally loses contact with the trailing end of the previous guide surface 21, 22 and 23.

FIGS. 4A, 4B and 4C illustrate a portion of an alternative improved design based on the echelon design of FIG. 1. In this design front face 1 is downward sloping. Instead of chamfering the front face 1 at its right hand end 12B and 13B, in this design it has to be angled out of the plane of FIG. 4A as shown in FIG. 4B. In this design the upper guide edges 21, 22 and 23 provide the same function as the echelon of FIG. 1 and the lower guide edges 21, 22 and 23 of FIG. 3. In FIG. 4A the gaps 51 and 52 are also angled to suit a different placing of yarn feed guides 41 and 42. Ratchet notches as in FIG. 3 may be added.

In FIGS. 5A and 5B a metal strip 60 has been cut to make slots 51 and 52 part way across its width: the strip has been bent downwards on the right hand sides 11A and 12A of each slot and upwards on the left hand sides 12B and 13B of each slot. The front guide edge 21, 22 and 23 of the strip has also been cut back at 70 on the upward bent portions 12B and 13B, and blind ended self threading guide slots 71, 72 have been cut out of the strip to communicate with the selector slots 51 and 52. In operation a yarn advancing from high left to low right in the plane of FIG. 5A and deflected over the guide edge 21, 22 of the assembly will not fall into a slot 51 and 52 but a yarn travelling essentially vertically in the plane of FIG. 5A as it reaches a slot will fall into it; and as its angle then becomes high right to low left in the plane of FIG. 5A it will engage in the self threading guide communicating with the slot which has selected it. This embodiment is suitable for use with a multicop winder as a moveable combined selector/donning guide assembly and is preferably used in combination with another fixed, selector guide assembly positioned above the traverse guides of the winder. Ratchet notches as in FIG. 3 may be added.

FIG. 6 illustrates a preferred duplex fixed selector guide assembly with selector guide members 11*a*, 11*b*, 12*a*, 12*b*, 13*a* and 13*b* of the kind illustrated in FIGS. 3A and 3B: the upper guide members being attached in front of the casing 80 of a four cop winder by members 81, 82 and 83 and the lower guide members being rigidly suspended from the upper members by support members 84, 85 and 86. A duplex nose member assembly with arcuate guide surfaces 7*a* and 7*b* is attached to the outer end of the winder casing 80 in position to form a first pair of selector gaps in association with members 11*a* and 11*b*, as well as to provide an arcuate guiding nose to deflect the yarns onto the assemblies as the aspirator 6 moves to the left. Donning guides 90, 91, 92 and 93 mounted on a moveable arm 94, are positioned near the lower selector guides 11*b*, 12*b* and 13*b*. Two sets of yarn winding guides, namely reciprocating traverse winding guides 95*a*, 95*b*, 95*c* and 95*d* and tail winding guides 96*a*, 96*b*, 96*c* and 96*d* are positioned between the upper and lower selector guide assemblies and above a helically grooved yarn traverse roll 97 and empty bobbins 98*a*, 98*c* and 98*d* driven by a drive roll behind the traverse roll and therefore not visible in the figure. The tail winding guide 96 consists of a slidable portion 99 having a long yarn collecting edge 100 and a guide slot 101; and a fixed portion 102 having a nose 103 and a slot 104. In operation a yarn falling through a pair of selector assembly slots impinges on edge 100 and as the aspirator continues to move to the left it is entrained in slot 101 to wind a tail. A timed interval after operating the donning guide, portion 99 slides so that nose 103 lifts the yarn out of slot 101 and then allows it to fall into the path of the traverse guide 95*a*, 95*b*, 95*c* and 95*d* which entrains it. The traversing yarn is able to follow the full right hand stroke of the traverse guide by entering slot 104.

Four threadlines 31, 32, 33 and 34 are illustrated in FIG. 6 travelling from fixed feed guides 41, 42, 43 and 44 to an aspirator 6; they are illustrated in position after selection by moving the aspirator to the left and back, being threaded individually into the tail winding guides 96*a*, 96*b*, 96*c* and 96*d* and the donning guides 90, 91, 92 and 93; and before operation of the donning guides 90, 91, 92 and 93 by movement of member 94 round bobbins 98 which will initiate the known sequence of attaching yarns 31, 32, 33, 34 to bobbins 98, cutting them away from the aspirator, and finally transferring them from tail winding guides 96*a*, 96*b*, 96*c* and 96*d* to traverse winding guides 95*a*, 95*b*, 95*c* and 95*d*.

A multiplex yarn selector guide assembly comprising a plurality of rows of selector guides is preferred to a simplex yarn selector guide assembly comprising a single row of selector guides for three reasons. Firstly, when used in association with a yarn winder, it provides a more compact way of guiding yarns before selection round the winder from a feed guide above to an aspirator below without fouling the winder or adjacent winders. This compactness not only permits close spacing of adjacent winders but also reduces the change in yarn path length associated with the selector action and therefore reduces tension fluctuations.

Secondly a multiplex arrangement provides for more positive entrainment when each yarn has to be threaded into more than one guide, for instance into a donning guide and a winding guide, because each guide can be near a selector.

Thirdly it permits positioning of the gaps so that a yarn is progressively selected by the different rows of guides at different moments instead of at the same time. This further reduces the yarn tension fluctuations associated with the selector and entrainment actions and provides more robust and consistent operation. A pair of yarn selector guide assemblies as in FIG. 6 is commonly sufficient.

We claim:

1. An elongate yarn guide assembly for selecting individual yarns from a group concurrently deflected over it and sliding laterally along it while advancing longitudinally from fixed spaced apart individual yarn feed means to moveable common yarn collection means, the assembly comprising a row of yarn guide members having yarn guiding surfaces separated by gaps characterized in that the yarn guiding surfaces of the guide members immediately beyond the gaps are inclined to, and at least partially face, the direction from which the yarns approach the gaps, whereby a yarn deflected over and sliding along the assembly passes over the guiding surfaces and the gaps without impedance from hooking except when the yarn lies in a plane wholly within a gap in which case it falls into that gap.

2. An assembly according to claim 1 characterised in that each guiding surface immediately beyond the gaps contains at least one ratchet notch which serves to prevent reverse yarn movement back towards the gaps.

3. An assembly according to claim 1 including an arcuate nose guide whereby a yarn travelling longitudinally directly between said feed means and said collection means and travelling laterally towards the assembly is deflected by the nose guide so that the yarn is caused to slide over the guiding surfaces in the assembly.

4. A structure comprising in combination an elongated yarn guide assembly according to claim 1 and a plurality of self threading guides, in which each gap between the guiding surfaces is the entrance into a self threading yarn guide.

5. A yarn guide assembly comprising in combination a plurality of elongate yarn guide assemblies according to claim 1, for selecting yarns concurrently from the same group, said assemblies being positioned in a general parallel relationship to each other, said gaps between said yarn guide members being orientated directly in a line with the yarn feed means, said gaps being so positioned relative to each other that a yarn is selected by said gaps in each elongate yarn guide assembly at different moments as it traverses the assembly.

6. A winder for simultaneously winding a plurality of cops including two or more yarn guides associated with each cop being wound and a plurality of fixed elongate yarn guide assemblies each according to claim 1 in which the gaps in the guide assemblies are positioned so that yarns falling through them engage in appropriate yarn guides on the winder.

7. A winder according to claim 6 in which the gaps in the guide assemblies are positioned so that a yarn falls through each of said gaps when aligned directly below the yarn feed means.

* * * * *